US005810551A

United States Patent [19]

Yamanaka

[11] Patent Number: 5,810,551

[45] Date of Patent: Sep. 22, 1998

[54] SHEET CONTAINING APPARATUS AND IMAGE FORMING APPARATUS

[75] Inventor: Yuji Yamanaka, Kawasaki, Japan

[73] Assignee: Canon Kabushiki Kaisha, Tokyo, Japan

[21] Appl. No.: 588,421

[22] Filed: Jan. 18, 1996

[30] Foreign Application Priority Data

Jan. 20, 1995 [JP] Japan ..... 7-007534

[51] Int. Cl.[6] ..... B65G 57/09

[52] U.S. Cl. ..... 414/790.7; 270/58.01; 399/405

[58] Field of Search ..... 270/58.01, 58.28; 399/405; 414/790.2, 790.4, 790.7

[56] References Cited

U.S. PATENT DOCUMENTS

| | | | |
|---|---|---|---|
| 4,640,506 | 2/1987 | Luperti et al. | 414/790.7 X |
| 4,925,180 | 5/1990 | Golicz | 414/790.7 X |
| 5,098,074 | 3/1992 | Mandel et al. | 270/53 |
| 5,147,092 | 9/1992 | Driscoll et al. | 414/790.7 X |
| 5,178,379 | 1/1993 | Edwards et al. | 414/790.7 X |
| 5,342,034 | 8/1994 | Mandel et al. | 270/53 |
| 5,545,000 | 8/1996 | Gorsky | 414/790.7 X |
| 5,623,722 | 4/1997 | Hawley et al. | 270/58.01 X |
| 5,695,181 | 12/1997 | Yamanaka | 270/58.01 X |

FOREIGN PATENT DOCUMENTS

| | | |
|---|---|---|
| 0589455A2 | 3/1994 | European Pat. Off. . |
| 0636496A1 | 2/1995 | European Pat. Off. . |
| 6-234461 | 8/1994 | Japan . |

*Primary Examiner*—Janice L. Krizek
*Attorney, Agent, or Firm*—Fitzpatrick, Cella, Harper & Scinto

[57] ABSTRACT

The present invention provides a sheet containing apparatus comprising a sheet introduction inlet portion, containers disposed in a line, and a convey member disposed between the sheet introduction inlet and the containers and movable along the containers and adapted to stack a plurality of sheets discharged from the sheet introduction inlet, to be shifted, after stacking of the sheets, to a position where the convey member is opposed to a selected container and to discharge the stacked sheets thereinto.

26 Claims, 11 Drawing Sheets

RELATED BACKGROUND ART

SHEET CONTAINING APPARATUS AND IMAGE FORMING APPARATUS

BACKGROUND OF THE INVENTION

1. Field of the Invention

The present invention relates to a sheet conveying apparatus and a sheet containing apparatus having such a sheet conveying apparatus. More particularly, it relates to a sheet containing apparatus which is connected to a copying machine having a reading apparatus, a facsimile machine (communication system), a printer connected to a computer or a binding apparatus (such as a stapler, gluing apparatus and the like), for example, and which is adapted to convey, sort and contain sheets or sheet bundles discharged from such a copying machine and the like, and an image forming apparatus having such a sheet containing apparatus.

2. Related Background Art

FIG. 11 is an explanatory view showing an example of a sheet containing apparatus proposed in the prior art.

Conventionally, as a sheet containing apparatus capable of sorting and containing sheets, for example, as shown in FIG. 11, an apparatus comprising a vertical convey path 102 including a plurality of convey rollers and a plurality of flappers, a lift/lower convey member 101, and a plurality of containing bins 103 has been proposed. In this arrangement, for example, when a command for discharging a plurality of sheets into the bin 103*a* is inputted by an operator, the lift/lower convey member 101 is lifted up to a level corresponding to the bin 103*a*, and each sheet is directed upwardly by a flapper 104*b* disposed in an entrance portion 104 and then is conveyed through the vertical convey path 102 to reach the lift/lower convey member 101 through a flapper 102*a*. The sheets are discharged from the lift/lower convey member 101 into the bin 103*a* one by one.

However, in the above-mentioned prior art technique, since the sheets are sorted in the vertical convey 102, a large number of rollers, flappers and guides are required in correspondence to a large number of containing bins 103, thus making compactness of the apparatus difficult and making the apparatus expensive. Further, since the sheets are discharged into the bin one by one, the sheets are not aligned with each other in the bin frequently.

SUMMARY OF THE INVENTION

An object of the present invention is to provide a sheet containing apparatus for sorting and containing sheets and an image forming apparatus which can be made compact and can be made cheaper.

Another object of the present invention is to improve alignment of contained sheets in a sheet discharging or conveying direction.

To achieve the above objects, according to the present invention, there is provided a sheet containing apparatus comprising a sheet introduction inlet portion, a containing means having an array of containers disposed in a column, and a convey member disposed between the sheet introduction inlet portion and the containing means and movable along the array of the containing means and adapted to stack a plurality of sheets discharged from the sheet introduction inlet portion, to be shifted, after stacking of the sheets, to a position where the convey member is opposed to a selected container of the containing means and to discharge the stacked sheets into the selected container.

Further, the present invention provides a sheet containing apparatus comprising a sheet introduction inlet portion, a containing means having an array of containers disposed in a column, and a convey member disposed between the sheet introduction inlet portion and the containing means and movable along the array of containers and adapted to stack a plurality of sheets discharged from the sheet introduction inlet portion, to be shifted, after stacking of the sheets, to a position where the convey member is opposed to a selected container of the containing means and to discharge the stacked sheets into the selected container, and wherein the convey member includes an alignment means for aligning the sheets to be stacked with each other.

Incidentally, a sheet stacking means for stacking the sheets may comprise a convey belt for receiving, stacking and conveying the sheets, and a tip end abutment member which can be retarded and against which a tip end of the sheet on the convey belt abuts to be stopped. Alternatively, the sheet stacking means may comprise a convey belt for receiving, stacking and conveying the sheets, an elastic roller urged against the convey belt to form a nip therebetween, and a nip introduction means comprised of an elastic member capable of directing the sheet on the convey belt so that a tip end of the sheet abuts against the elastic roller to be stopped.

In this case, it is preferable that the convey belt is inclined downwardly toward a sheet conveying direction. Further, the elastic roller is preferably made of foam urethane.

In addition, the alignment means may comprise a side jogging means for aligning the sheet in a direction transverse to the sheet conveying direction. Alternatively, the alignment means may comprise a sweeping means for sweeping up the sheets conveyed from the sheet stacking means together in the sheet conveying direction. When the alignment means is such a sweeping means, it is desirable that the sweeping means is formed from foam urethane.

Further, when the sheets are received and sorted, after only a first sheet among the sheets successively conveyed to the convey member is conveyed to the nip between the elastic roller and the convey belt by means of the convey belt and the sweeping means or by means of the convey belt, a second, a third sheet and so on are urged against the elastic roller so that these sheets are stopped and aligned with each other.

With the arrangement as mentioned above, according to the sheet containing apparatus of the present invention, the sheets conveyed to the convey member are aligned with each other by means of the alignment means and the aligned sheets are discharged into the selected container. Further, in the case where the sheet stacking means comprises the convey belt and the abutment member, when the aligned sheet bundle is conveyed, the abutment member is retarded to a position where it does not interfere with the sheet bundle.

On the other hand, in the case where the sheet stacking means comprises the convey belt, the elastic roller and the nip introduction means the nip introduction means can prevent the tip end of the sheet from being caught by a relatively upper portion of a peripheral surface of the elastic roller. Further, when the convey member is lifted or lowered, the nip introduction means pinches the sheet bundle. In addition, by inclining the convey belt downwardly toward the sheet conveying direction, the tip ends of the sheets successively conveyed abut against the abutment member or the elastic roller by their own inertia forces and their own weights due to the inclination of the convey belt.

Further, in the case where the elastic roller is formed from the foam urethane, when the aligned sheet bundle is conveyed again and is discharged into the container, the urethane foam roller is elastically deformed in accordance with a thickness of the sheet bundle. The urethane foam roller can reduce coefficient or reaction to be as small as possible.

In the case where the alignment means comprises the side jogging means, when the aligned sheet bundle is conveyed, the side jogging means is retarded to a position where it does not interfere with the sheet bundle. On the other hand, in the case where the alignment means comprises the sweeping means, the sweeping means sweeps up the sheets in the sheet conveying direction until the sheets abut against the elastic roller or the abutment member, and, after the abutting of the sheets, the sweeping means can slip on the sheet bundle to exert a predetermined urging force (acting toward the sheet conveying direction) on the sheet bundle.

In the case where the sweeping means is formed from the foam urethane, the sweeping means comprised of an urethane foam roller and the like is elastically deformed gradually as the sheets are successively stacked, so that the sweeping ability of the sweeping means is maintained regardless of the thickness of the sheet bundle.

According to the sheet containing method of the present invention, in the sheet containing apparatus, when the sheets are received and sorted, after only a first sheet among the sheets successively conveyed to the convey member is conveyed to the nip between the elastic roller and the convey belt by means of the convey belt and the sweeping means or by means of the convey belt, a second, a third sheet and so on are urged against the elastic roller so that these sheets are stopped and aligned with each other.

As mentioned above, according to the sheet containing apparatus of the present invention, since the sheets are once stacked to form the sheet bundle and the sheet bundle is then discharged, the alignment of the contained sheet bundle can be improved. Further, since the sheets conveyed to the convey member are aligned with each other by means of the alignment means and then the sheet bundle comprised of the aligned sheets is discharged into the selected container, the alignment of the sheets contained in the container can be improved. Further, by providing the alignment means in the convey member, the cost-down can be achieved and the space can be saved.

In the case where the sheet stacking means comprises the convey belt and the abutment member, when the aligned sheet bundle is conveyed, since the abutment member is retarded to the position where it does not interfere with the sheet bundle, the sheet bundle is not distorted. This is preferable.

On the other hand, in the case where the sheet stacking means comprises the convey belt, the elastic roller and the nip introduction means, the nip introduction means can prevent the tip end of the sheet from being caught by the relatively upper portion of the peripheral surface of the elastic roller, thereby improving the alignment of the sheets. Further, when the convey member is lifted or lowered, since the nip introduction means pinches the sheet bundle, the sheet bundle is not distorted. This is preferable. Further, since the elastic roller can have a function of abutting the tip end of the sheet, and, thus, since the abutment member can be omitted, the space can be saved.

In addition, by inclining the convey belt downwardly toward the sheet conveying direction, the tip ends of the sheets successively conveyed abut against the abutment member or the elastic roller by their own inertia forces and their own weights due to the inclination of the convey belt, thereby easily improving the alignment of the sheets in the sheet conveying direction.

Further, in the case where the elastic roller is formed from the foam urethane, when the aligned sheet bundle is conveyed again and is discharged into the container, since the urethane foam roller is elastically deformed in accordance with the thickness of the sheet bundle, the sheet bundle can be conveyed without provision of a complicated roller separating mechanism and the like. In addition, since the urethane foam roller can reduce the coefficient of reaction to be as small as possible, when the sheet bundle or the sheet enters into the nip between the urethane foam roller and the convey belt, the tip end of the sheet bundle or the sheet is not damaged. This is preferable.

Further, in the case where the alignment means comprises the side jogging means, when the aligned sheet bundle is conveyed, since the side jogging means is retarded to the position where it does not interfere with the sheet bundle, the sheet bundle is not distorted. This is preferable.

On the other hand, in the case where the alignment means comprises the sweeping means, since the sweeping means sweeps up the sheets in the sheet conveying direction until the sheets abut against the elastic roller or the abutment member, and, after the abutting of the sheets, the sweeping means can slip on the sheet bundle to exert the predetermined urging force (acting toward the sheet conveying direction) on the sheet bundle, the alignment of the sheets can easily be improved.

Further, in the case where the sweeping means is formed from the foam urethane, the sweeping means comprised of the urethane foam roller and the like is elastically deformed gradually as the sheets are successively stacked, so that the sweeping ability of the sweeping means is maintained regardless of the thickness of the sheet bundle. This is preferable.

In the sheet containing apparatus, when the sheets are received and then are sorted, after only the first sheet among the sheets successively conveyed to the convey member is conveyed to the nip between the elastic roller and the convey belt by means of the convey belt and the sweeping means or by means of the convey belt, the second, the third sheet and so on are urged against the elastic roller so that these sheets are stopped and aligned with each other. In this case, regarding the first sheet, since there is no difference in relative speed between the convey belt and the sheet, the alignment of the sheet can stably be performed regardless of coefficient of friction between the sheet and the convey belt. This is preferable.

Further, since an image forming apparatus according to the present invention utilizes the above-mentioned sheet containing apparatus, the image forming apparatus can be made compact and cheaper, and the alignment of the sheet bundle can be improved.

DETAILED DESCRIPTION OF THE PREFERRED EMBODIMENTS

Figure 1:
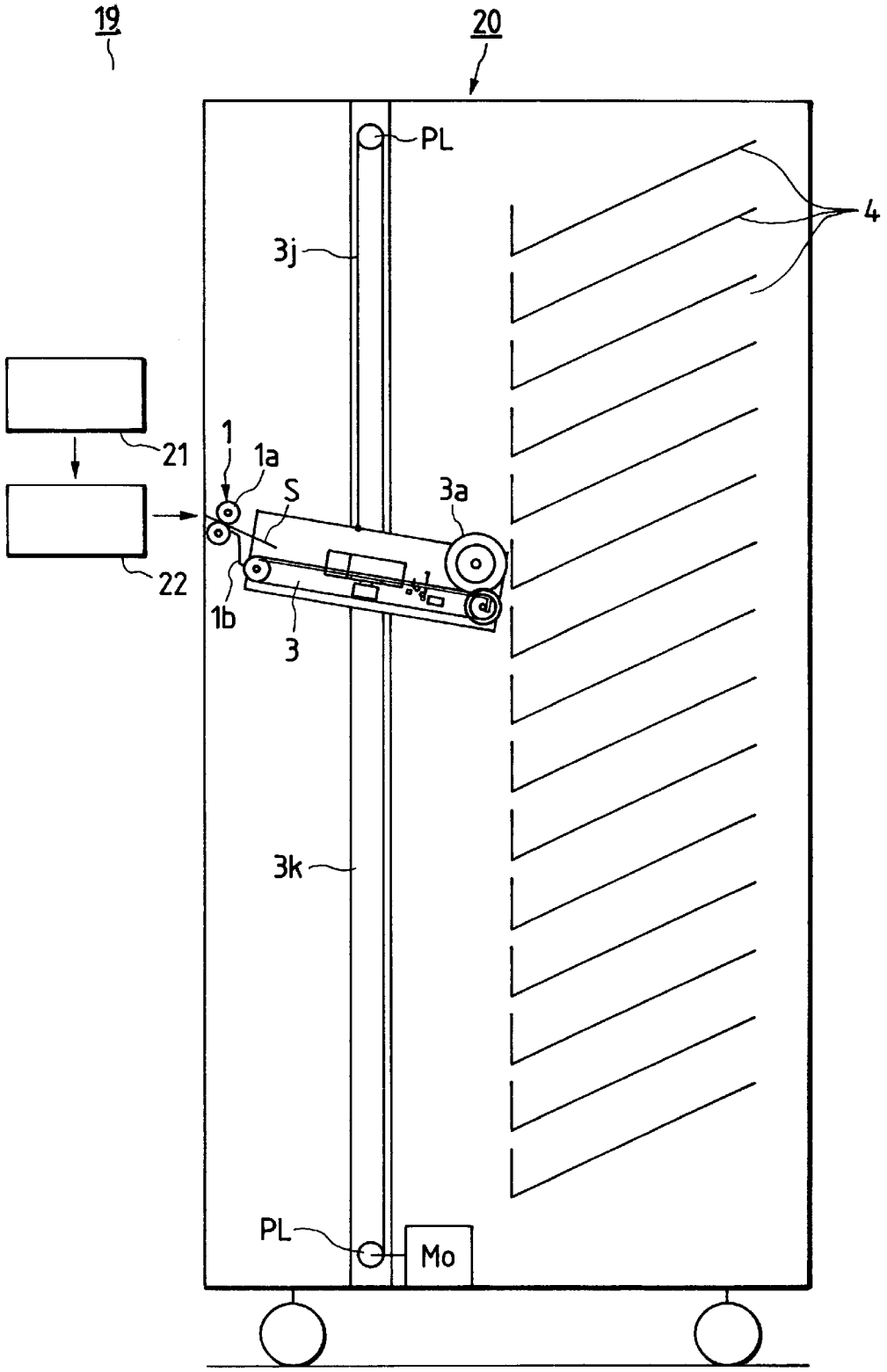
FIG. 1 is an elevational sectional view showing an example of a sheet containing apparatus according to the present invention.

First of all, a first embodiment of the present invention will be explained. FIG. 1 is an explanatory view showing an example of a sheet containing apparatus according to the present invention.

Figure 10:
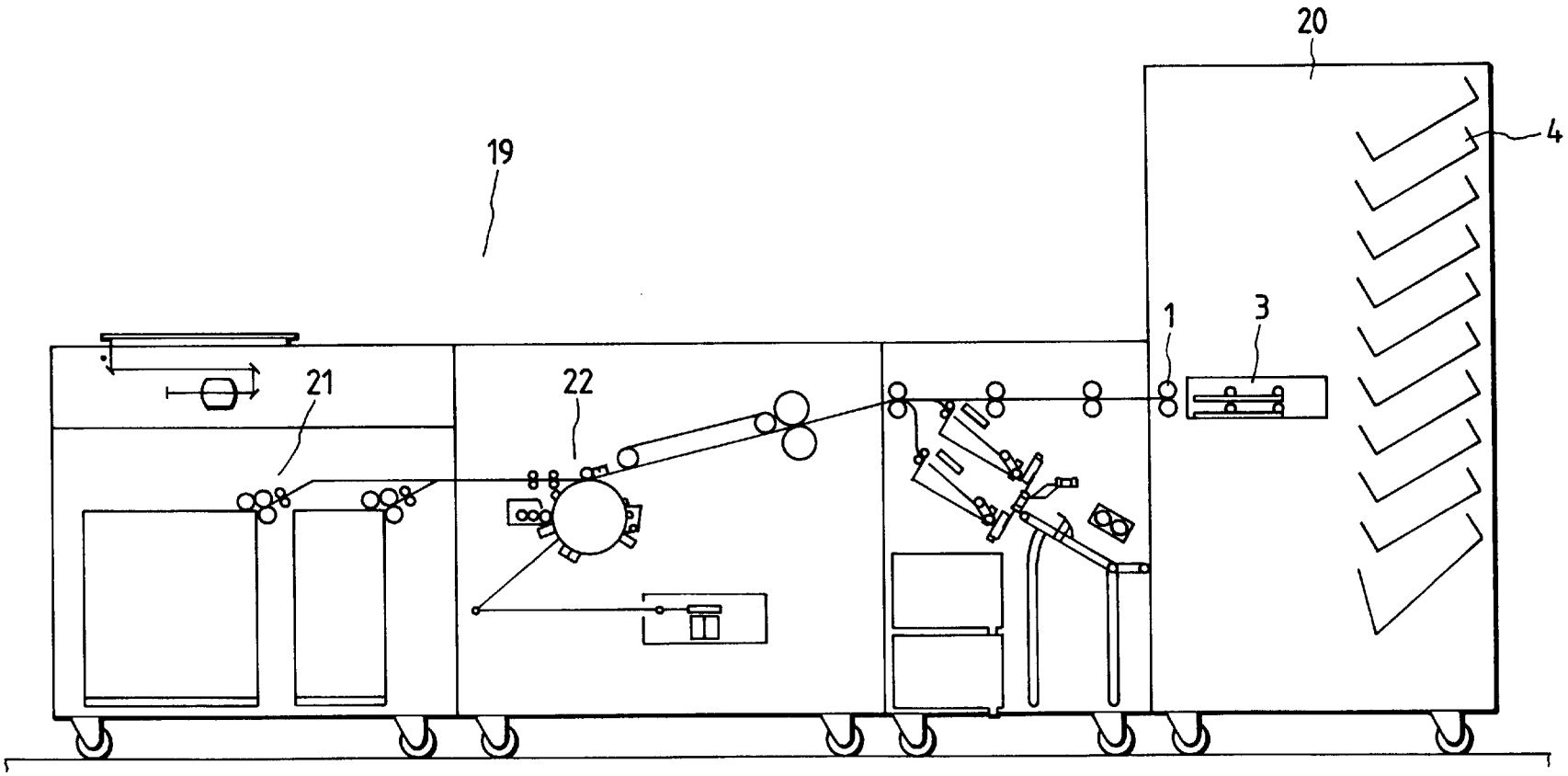
FIG. 10 is an elevational sectional view of an image forming apparatus according to the present invention.
Figure 11:
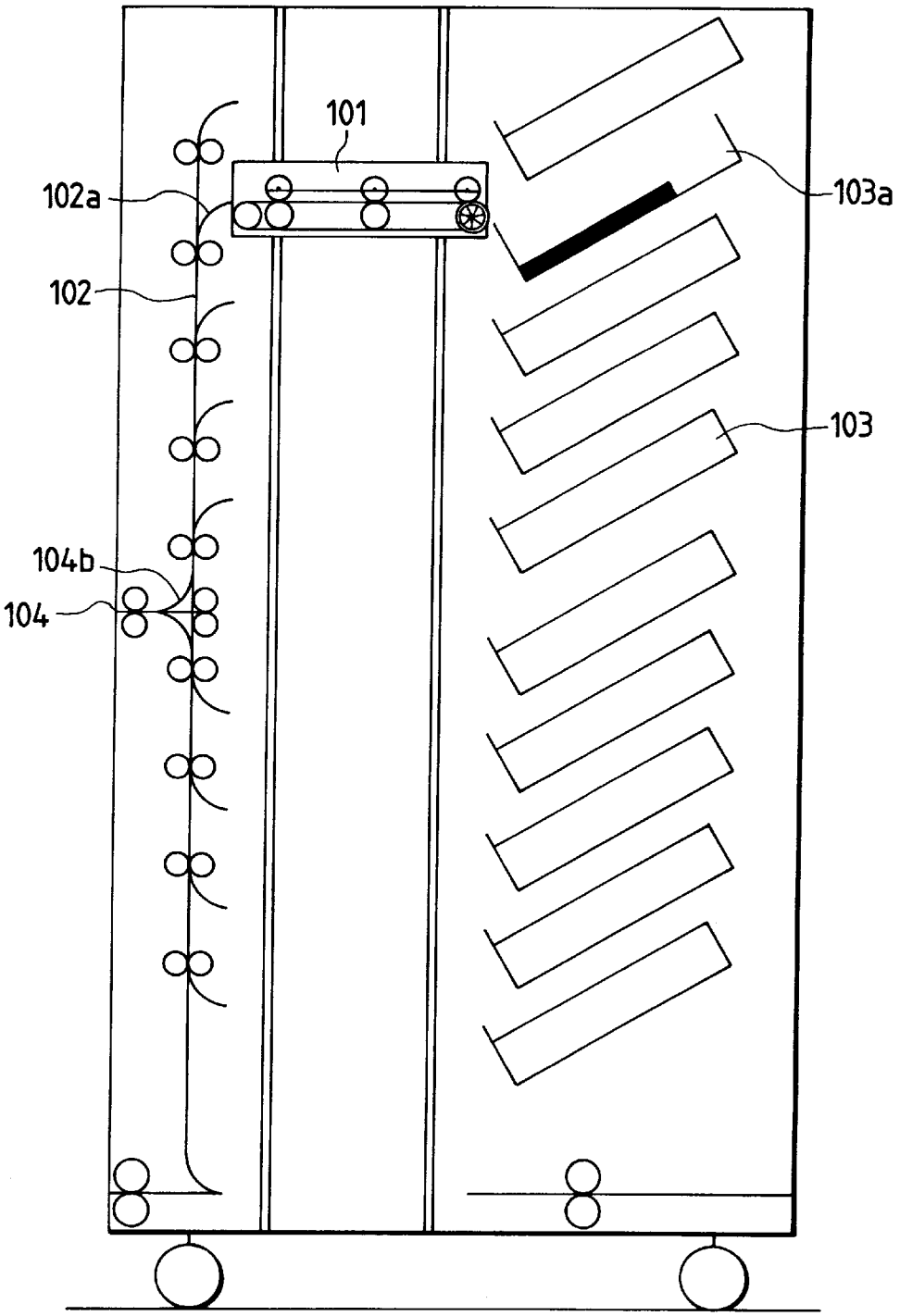
FIG. 11 is an elevational sectional view showing an example of a conventional sheet containing apparatus.

As shown in FIGS. 1 and 10, an image forming apparatus 19 comprises a sheet supply means 21 capable of supplying sheets S and including sheet cartridges and sheet supply rollers, an image forming means 22 capable of forming an image on the sheet S and discharging the imaged sheet and including a photosensitive drum, a developing device, a transfer portion and the like, and a sheet containing apparatus 20 according to the present invention. The sheet containing apparatus 20 has a sheet inlet portion 1 for receiving the sheet S discharged from the image forming means 22, which sheet inlet portion 1 includes a pair of inlet rollers 1*a* and a lower guide 1*b*.

Further, the sheet containing apparatus 20 has a lift/lower convey member 3 which is disposed at a downward side of the sheet inlet portion 1 (home position) and is inclined rightwardly and downwardly by an angle of about 15 degrees. This inclination serves to improve alignment of sheets in a sheet conveying direction. A relative angle between a sheet discharging angle of the pair of inlet rollers 1*a* and the inclination of the lift/lower convey member is about 10 degrees. When the sheet is discharged from the pair of inlet rollers 1*a*, in order to prevent the poor discharge of the sheet, a value of the above-mentioned relative angle is very important. This relative angle is preferably 10 to 25 degrees, and, in this embodiment, the relative angle is selected to be 10 degrees.

Further, the sheet containing apparatus 20 has a containing portion 4 including a plurality of containing bins disposed side by side in a vertical direction as an array, and the containing portion 4 is disposed at a downstream side of the lift/lower convey member 3.

Figure 2:
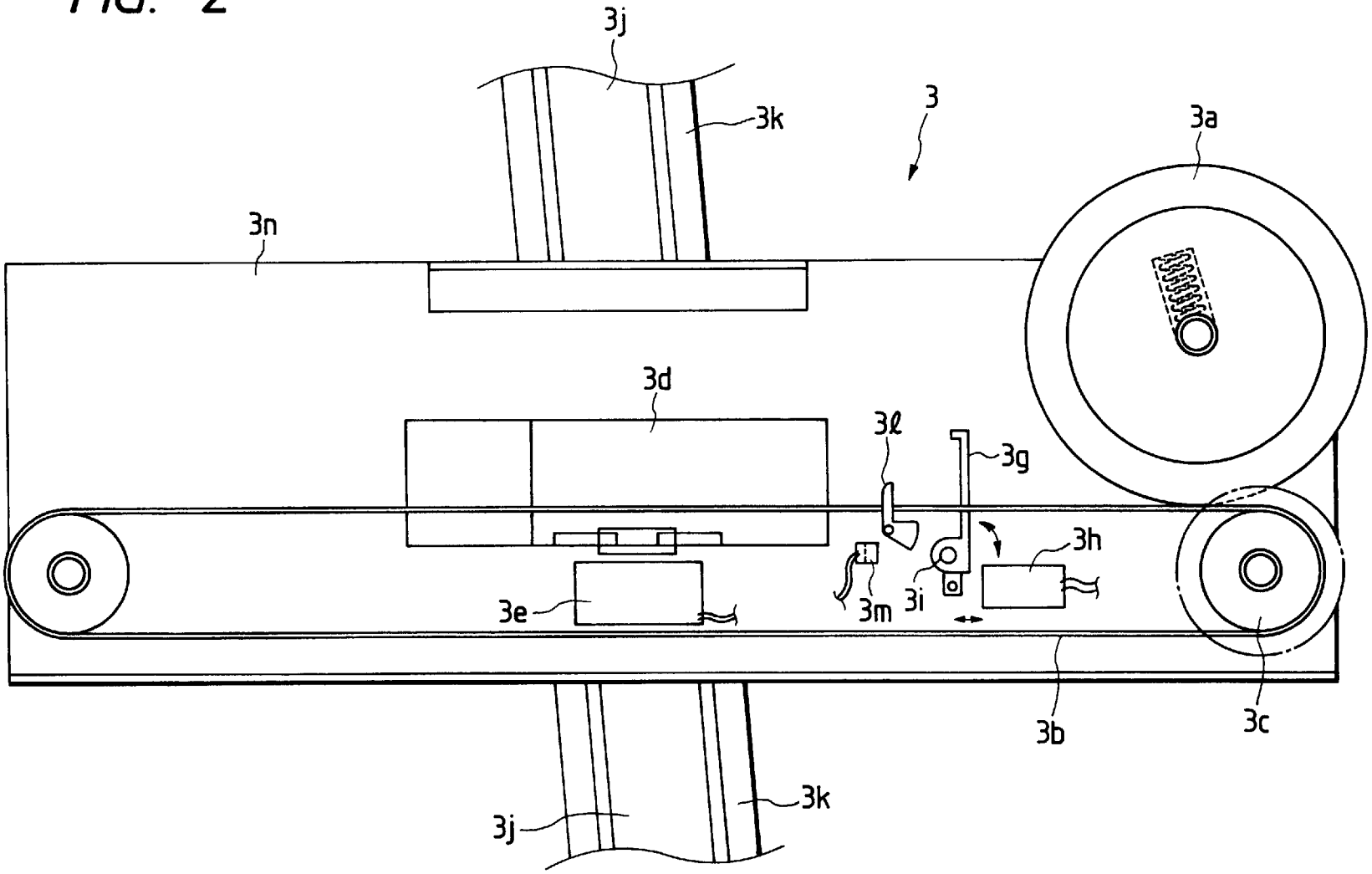
FIG. 2 is a view showing a lift/lower convey member of the sheet containing apparatus of FIG. 1.
Figure 3:
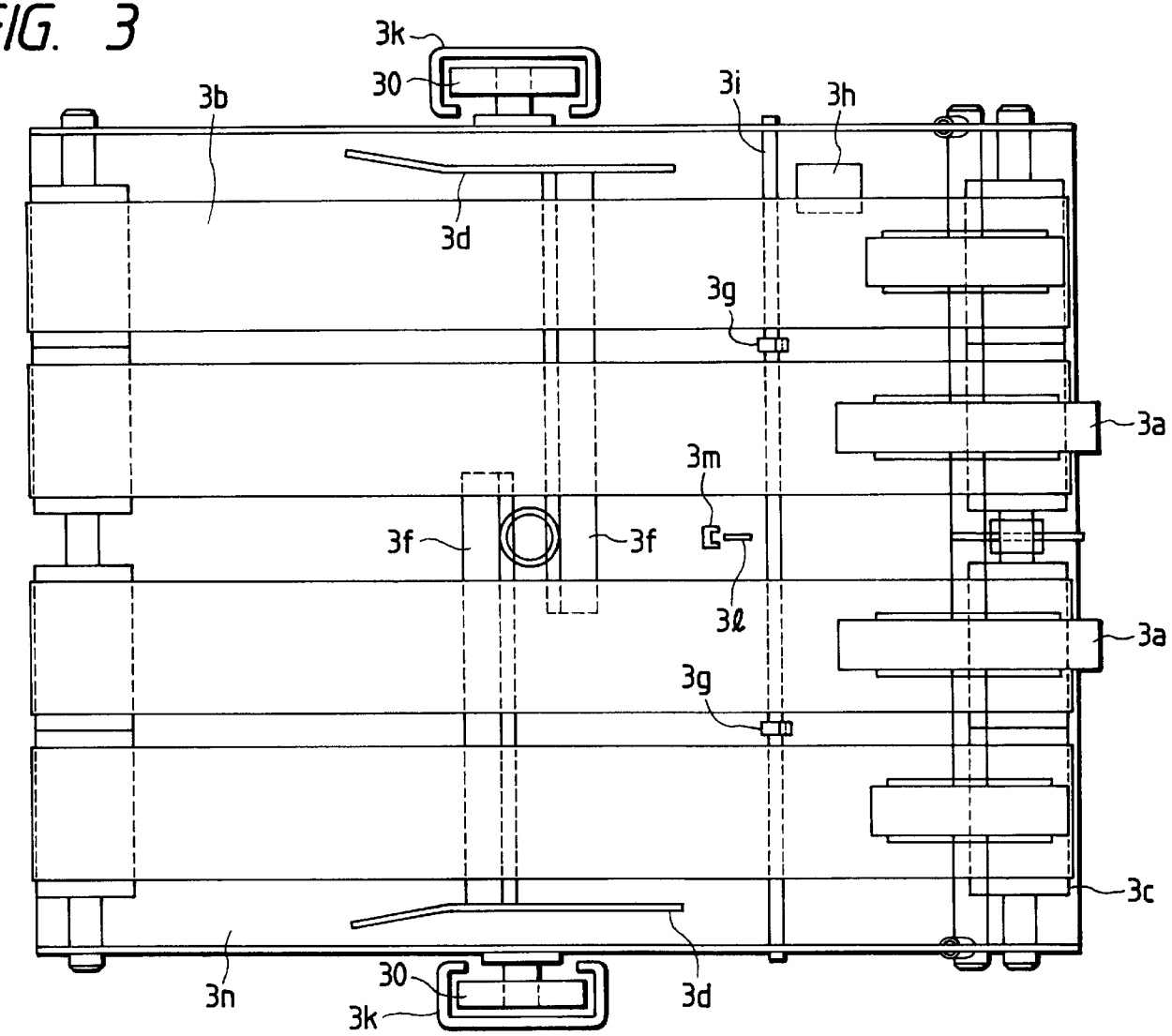
FIG. 3 is a plan view of the lift/lower convey member of FIG. 2.

Next, the lift/lower convey member 3 will be explained with reference to FIGS. 2 and 3.

The lift/lower convey member 3 has a frame 3*n*, and rail rollers 30 are guided on two rails 3*k* extending in a vertical direction outside the frame 3*n*. The lift/lower convey member 3 also has a timing belt 3*j* through which the lift/lower convey member 3 is driven by a drive motor Mo and pulleys PL.

Further, within the frame 3*n*, there are provided a rubber convey belt 3*b* made of EPDM (ethylene-propylene-dienemethylene linkage) and mounted around pulleys 3*c*, and an elastic roller 3*a* urged against the convey belt 3*b*. A nip is defined between the convey belt and the elastic roller. The elastic roller 3*a* can cope with a thickness of a stacked sheet bundle, and, in the illustrated embodiment, the elastic roller is a sponge roller formed from polyurethane foam and having an outer diameter of 80 mm and is driven by a shifting movement of the belt. Further, the elastic roller is urged against the belt 3*b* with low pressure.

Further, within the frame 3*n*, there are provided side joggers 3*d* with which rack portions 3*f* and a stepping motor 3*e* are associated. That is to say, the rack portions 3*f* are reciprocally driven by the stepping motor 3*e* so that the successively stacked sheets are aligned with each other on both sides.

Furthermore, there is provided an abutment plate 3*g* against which tip ends of the stacked sheets can abut. The abutment plate 3*g* can be rotated around a shaft 3*i*. A solenoid 3*h* is associated with the abutment plate 3*g* so that the abutment plate 3*g* can be shifted between an upright position (stop position) and a laid position (regard position) by ON/OFF of the solenoid 3*h*. A sheet detection means 3*l* is disposed at a side of the convey belt 3*b* so that the timing of the convey belt 3*b* is controlled by the sheet detecting means 3*l*.

Next, an operation of the sheet containing apparatus 20 will be explained with reference to FIGS. 4 to 6.

Figure 4:
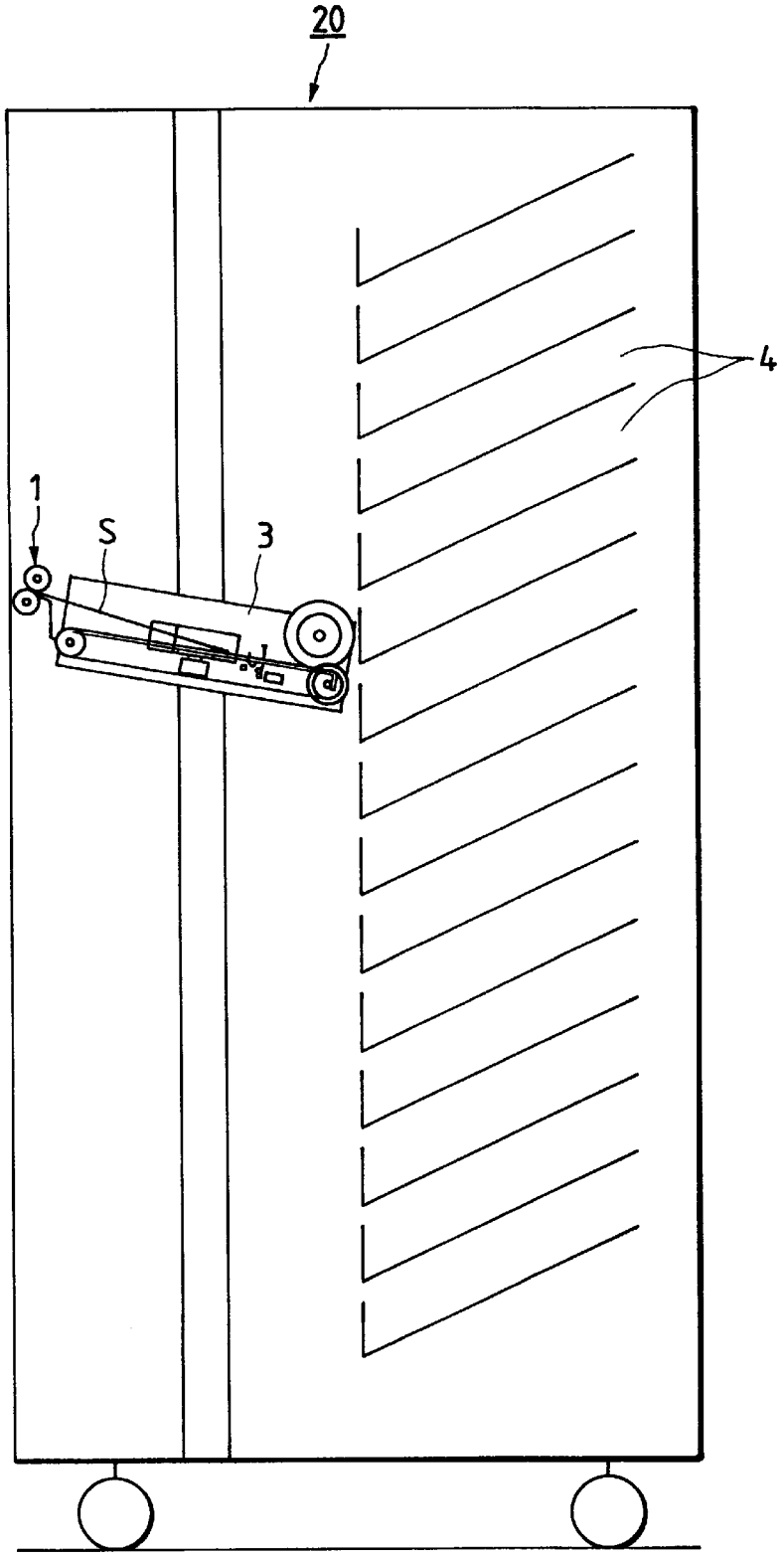
FIGS. 4 to 6 are elevational sectional views showing an operation of the sheet containing apparatus of FIG. 1.

FIG. 4 shows a condition that a first sheet S is being fed to the lift/lower convey member 3. In this case, the convey belt 3*b* is driven at a speed greater than a sheet conveying speed by 3%. The solenoid 3*h* is turned ON to cock the abutment plate 3*g* (upright position).

Then, after the sheet detecting means 3*l* is turned OFF (depressed) by the tip end of the sheet S, when a predetermined time period is elapsed, the convey belt 3*b* is stopped. The predetermined time period is a time duration from when the tip end of the sheet S turns OFF the sheet detection means 3*l* to when the tip end of the sheet abuts against the abutment plate 3*g*, and, in the illustrated embodiment, the predetermined time period T is selected so as to satisfy the following equation:

$$T=(L+\alpha)/v$$

Where, T is the predetermined time period (sec.), L is a distance between the sheet detection means 3*l* and the abutment plate 3*g* (mm), v is a speed of the convey belt (mm/sec.), and $\alpha$ is a value of 1 to 5 mm. Incidentally, the value $\alpha$ means an abutment amount (overrun) of the sheet S, and, in the illustrated embodiment, the value $\alpha$ was empirically selected to be 3 mm.

Figure 5:
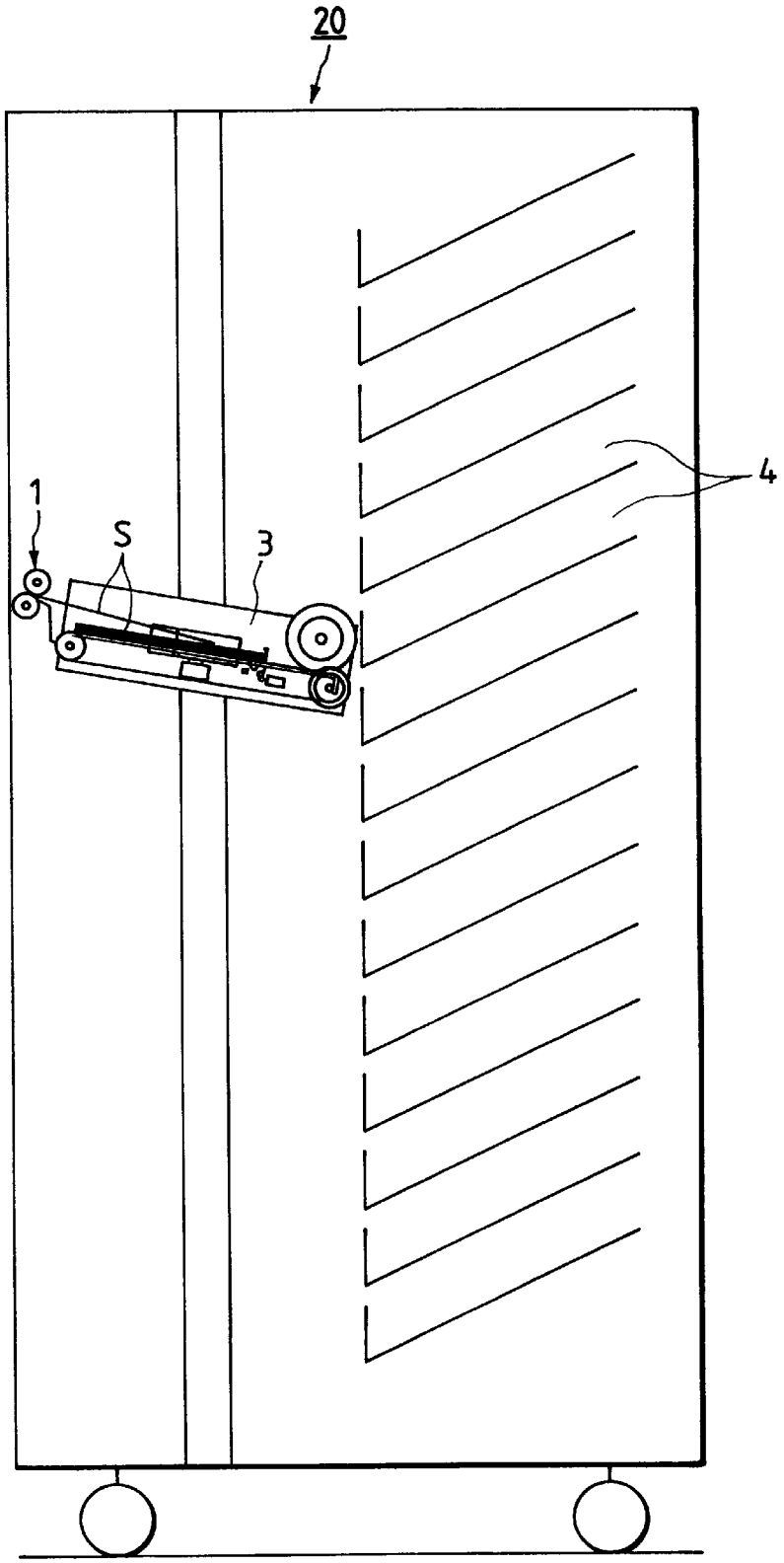

FIG. 5 shows a condition that the sheets are successively stacked on the convey belt 3*b*. When a second sheet, a third sheet and so on are stacked, the convey belt 3*b* is kept stationary.

Each sheet S is slid on the sheet stack by its own inertia and its own weight due to the inclination and abuts against the abutment plate 3*g* to be stopped. While the sheet is being moved, the side joggers 3*d* are retarded, when the sheet is stopped (after discharge of a trail end of the sheet from the entrance is detected), the side joggers 3*d* are shifted to the aligning position, thereby aligning the sheets in the widthwise direction.

Figure 6:
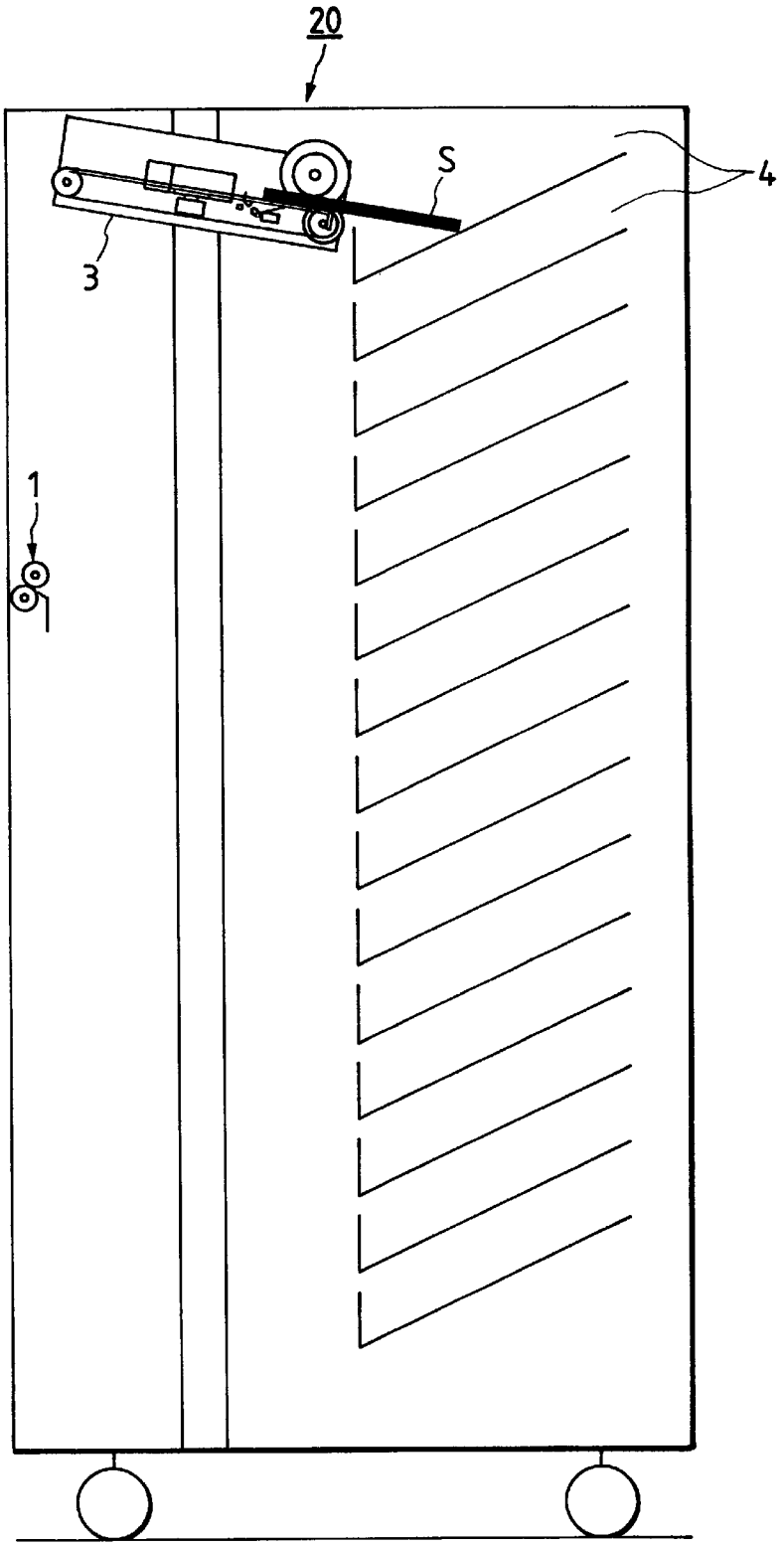

FIG. 6 shows a condition in which the aligned sheet bundle is being discharged into a selected containing bin after the lift/lower convey member 3 was lifted to a position corresponding to the selected containing bin (This position is detected by a sensor). In synchrony with initiation of the driving of the convey belt 3*b* at the position corresponding to the selected containing bin, the solenoid 3*h* is turned ON to release the abutment plate 3*g*. With the result that, the sheet bundle is pinched between the elastic roller 3*a* and the convey belt 3*b* and then is discharged into the selected containing bin. While the lift/lower convey member is being lifted, the sheet bundle is pinched by the side joggers 3*d* from both sides, and, immediately before the discharge of the sheet bundle, by retarding the side joggers, the alignment of the sheets is maintained even during the lifting movement of the lift/lower convey member.

When the completion of the discharge of the sheet bundle is detected, the lift/lower convey member 3 is then returned to its home position as shown in FIG. 1 where the lift/lower convey member is opposed to the sheet inlet portion 1 (This position is detected by a home position sensor), thereby restoring a waiting or stand-by condition.

With the arrangement as mentioned above, for example, in a case where fifteen copies are obtained for each of ten originals, when a certain containing bin is designated or selected, 150 (15×10) copies can be aligned with each other in the lift/lower convey member 3 to form a single sheet bundle and the obtained sheet bundle can be discharged into the selected containing bin. On the other hand, when it is designated that fifteen copies are sorted and discharged into fifteen containing bins, ten copies (one copy of each original) are firstly aligned with each other in the lift/lower convey member 3 to form a sheet bundle which is in turn discharged into a first containing bin, and, then, the next ten copies (one of each original) are aligned with each other in the lift/lower convey member 3 to form a sheet bundle which is in turn discharged into a second containing bin. By repeating the operation until a last sheet bundle of ten copies (one copy of each original) is discharged into a fifteenth containing bin, the sheets can be sorted and contained while keeping good alignment. The position of each of the containing bins can be detected by a sensor.

Next, a second embodiment of the present invention will be explained.

Figure 7:
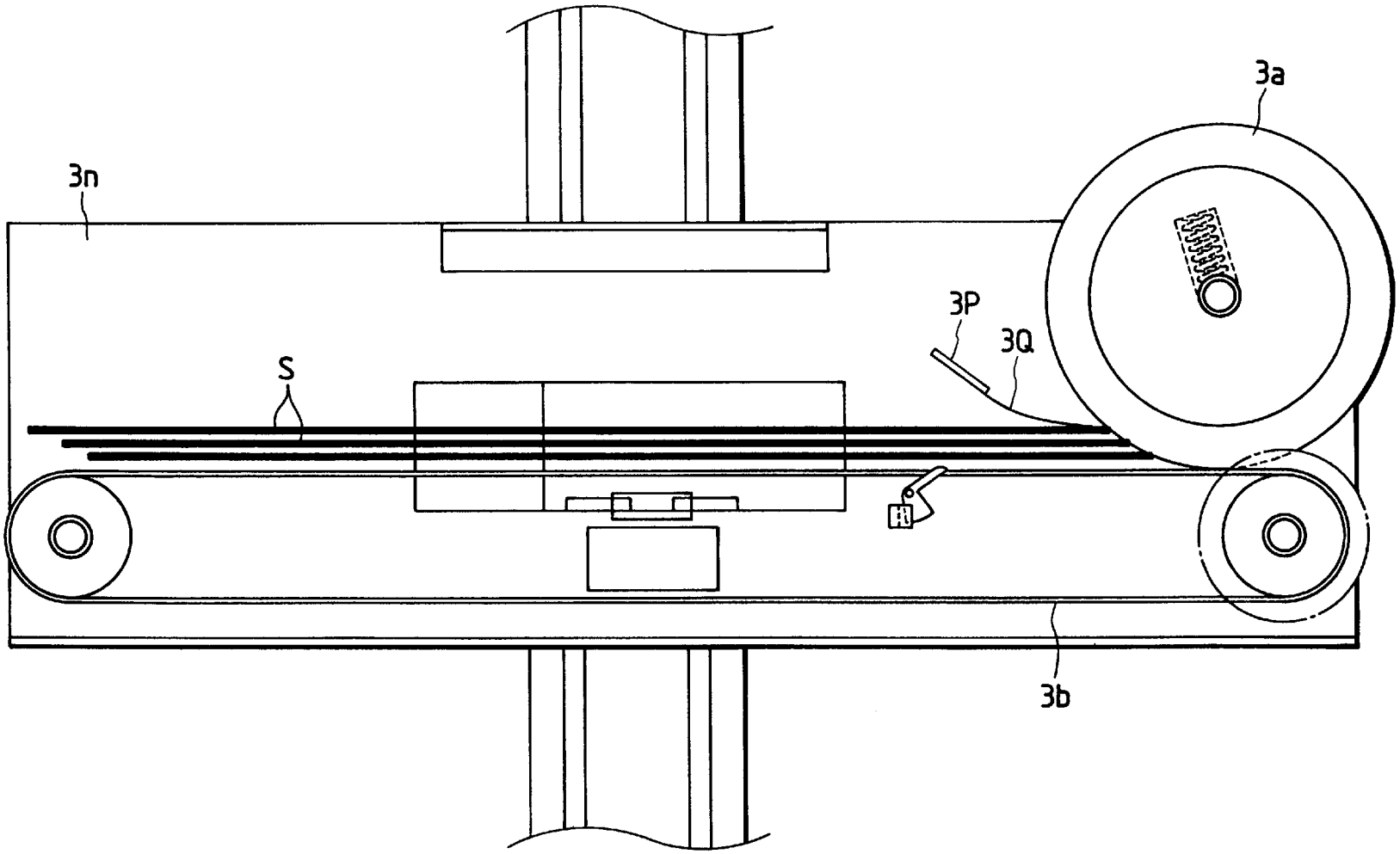
FIG. 7 is a view showing a lift/lower convey member of a sheet containing apparatus according to another embodiment of the present invention.

FIG. 7 is a view showing a lift/lower convey member of a sheet containing apparatus according to the second embodiment of the present invention.

The lift/lower convey member 3 according to the second embodiment differs from that of the first embodiment in the points that the abutment plate 3*g*, solenoid 3*h* and shaft 3*i* are omitted and that a nip introduction plate 3Q and a stay 3P are provided. The stay 3P is secured to the frame 3*n* of the lift/lower convey member and supports the nip introduction plate 3Q. The nip introduction plate 3Q is formed from an elastic member, and, in the illustrated embodiment, the nip introduction plate is formed from a Mylar sheet.

The nip introduction plate 3Q is inclined rightwardly and downwardly by an angle of 45 degrees so that a tip end of the conveyed sheet S (particularly, a curled tip end) can be smoothly directed to a wedged portion (nip) between the elastic roller 3*a* and the convey belt 3*b*. The nip introduction plate 3Q cooperates with the convey belt 3*b* to pinch the sheet S or the non-bound sheet bundle therebetween.

The first sheet S is conveyed in the same manner as the first embodiment, and the tip end of the sheet S is conveyed up to a position immediately ahead of the nip between the elastic roller 3*a* and the convey belt 3*b*. The second sheet and so on is slid rightwardly and downwardly by its own weight because of the inclination of the convey belt 3*b*, with the result that the tip end of the sheet abuts against the elastic roller 3*a* and is stopped there.

Figure 9:
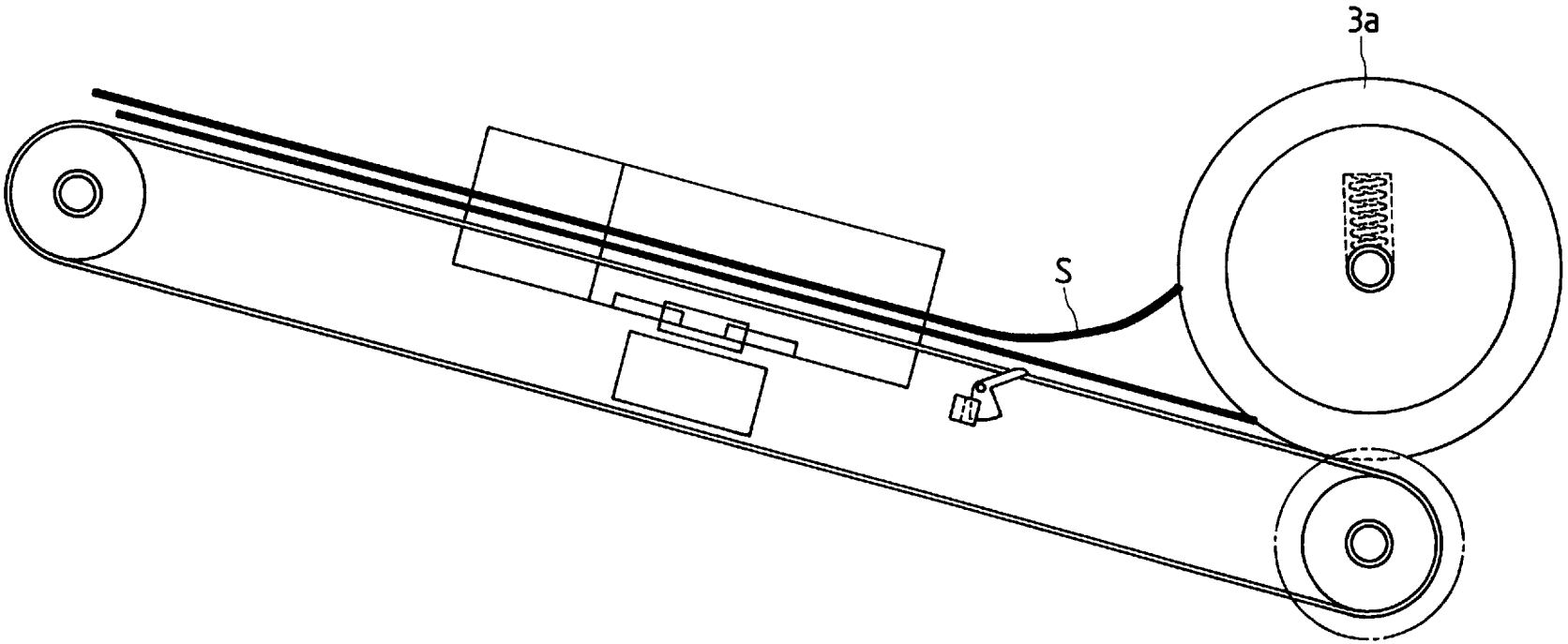
FIG. 9 is a view for explaining a condition in which a sheet is caught.

In this way, since the large diameter elastic roller is also used as an abutment means and the nip introduction plate is provided as an auxiliary means for the elastic roller, it is possible to provide a tip end alignment means which is very cheap and very stable. Incidentally, the nip introduction plate 3Q prevents the tip end of the sheet from being caught by a relatively upper portion of a peripheral surface of the elastic roller 3*a* as shown in FIG. 9, thereby improving the alignment of the sheets.

Next, a third embodiment of the present invention will be explained.

Figure 8:
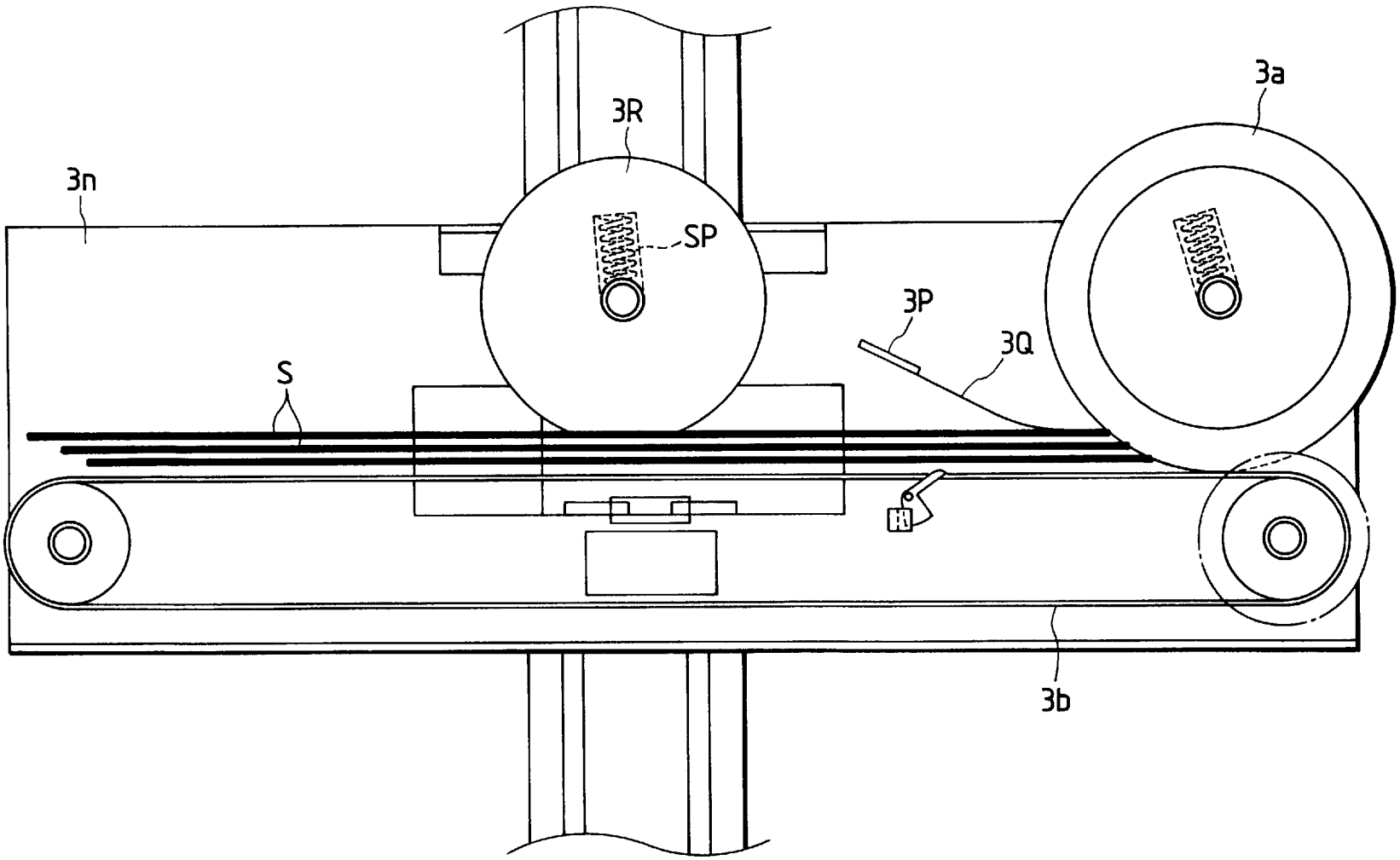
FIG. 8 is a view showing a lift/lower convey member of a sheet containing apparatus according to a further embodiment of the present invention.

FIG. 8 is a view showing a lift/lower convey member of a sheet containing apparatus according to the third embodiment of the present invention. The lift/lower convey member 3 according to the third embodiment differs from that of the second embodiment in the point that a sweeping means 3R is added.

The sweeping means 3R includes two large diameter sponge rollers made of foamed urethane and each having a diameter of 60 mm. These two sponge rollers are coaxially disposed, and skew-feed of the sheet can be corrected by abutting the tip end of the sheet against the sponge rollers.

A shaft on which the sweeping means 3R is mounted is supported by the frame via bearings and is biased downwardly by springs SP.

The sweeping means is driven by a motor (not shown) so that the sweeping means is being driven during the alignment of the sheets and the conveyance of the sheet bundle. Further, a sweeping force of the sweeping means is selected to be smaller than a buckling load of the sheet.

What is claimed is:

1. A sheet containing apparatus comprising:

a sheet introduction inlet;

containing means having a plurality of steps disposed in a line; and a convey member disposed between said sheet introduction inlet and said containing means and movable along the steps of said containing means and adapted to stack a plurality of sheets introduced from said sheet introduction inlet one by one in a sheet bundle, said convey member being shifted, after stacking of the sheets, to a position where said convey member is opposed to a selected step of said containing means to discharge the sheet bundle into said selected step.

2. A sheet containing apparatus according to claim 1, wherein said convey member has a convey belt on which the sheets can be stacked and which can discharge the sheets.

3. A sheet containing apparatus according to claim 2, wherein said convey member has a tip end abutment member for stopping a tip end of the introduced sheet.

4. A sheet containing apparatus according to claim 2, wherein said convey member further has a nip rotary member opposed to said convey belt.

5. A sheet containing apparatus according to claim 4, further comprising sweeping means for sweeping up the sheets together in a sheet conveying direction, and wherein, after only a first sheet among the sheets successively conveyed to said convey member is conveyed to a nip between said nip rotary member and said convey belt by means of said convey belt and said sweeping means, a second, a third sheet and so on are urged against said nip rotary member so that these sheets are stopped and aligned with each other.

6. A sheet containing apparatus according to claim 4, wherein said nip rotary member is an elastic rotary member made of a roller made of foam urethane.

7. A sheet containing apparatus according to claim 4, wherein said nip rotary member is an elastic roller.

8. A sheet containing apparatus according to claim 7, wherein, after only a first sheet among the sheets successively conveyed to said convey member is conveyed to a nip between said elastic roller and said convey belt by means of said convey belt, a second, a third sheet and so on are urged against said elastic roller so that these sheets are stopped and aligned with each other.

9. A sheet containing apparatus according to claim 1, wherein said convey member includes a convey belt for receiving and stacking the sheets, an elastic rotary member urged against said convey belt to form a nip therebetween, and nip introduction means made of an elastic member capable of directing the sheet on said convey belt so that a tip end of said sheet abuts against said elastic rotary member to be stopped.

10. A sheet containing apparatus according to claim 2 or 9, wherein said convey belt is inclined downwardly in a sheet conveying direction.

11. A sheet containing apparatus according to claim 9, wherein said elastic rotary member is made of a roller made of foam urethane.

12. A sheet containing apparatus according to claim 9, further comprising sweeping means for sweeping up the sheets in a sheet conveying direction.

13. A sheet containing apparatus according to claim 12, wherein said sweeping means is made of foam urethane.

14. A sheet containing apparatus according to claim 12, wherein, after only a first sheet among the sheets successively conveyed to said convey member is conveyed to the nip between said elastic rotary and said convey belt by means of said convey belt and said sweeping means, a second, a third sheet and so on are urged against said elastic rotary so that these sheets are stopped and aligned with each other.

15. A sheet containing apparatus according to claim 1, further comprising alignment means for aligning the stacked sheets with each other.

16. A sheet containing apparatus according to claim 15, wherein said alignment means is side jogging means.

17. A sheet containing apparatus according to claim 15, wherein said convey member has a belt on which the sheets can be stacked and which can discharge the sheets.

18. A sheet containing apparatus comprising:

a sheet introduction inlet;

containing means having a plurality of steps disposed in a line; and a convey member disposed between said sheet introduction inlet and said containing means and movable along the steps of said containing means and adapted to stack a plurality of sheets introduced from said sheet introduction inlet one by one in a sheet bundle, said convey member being shifted, after stacking of the sheets, to a position where said convey member is opposed to a selected step of said containing means to discharge the sheets into the selected step, wherein said convey member has alignment means for aligning the sheets to be stacked with each other.

19. A sheet containing apparatus according to claim 18, wherein said convey member has a belt means on which the sheets can be stacked and which can discharge the sheets.

20. A sheet containing apparatus according to claim 19, wherein said convey member further has a nip rotary member opposed to said belt means.

21. An image forming apparatus comprising:

image forming means;

a sheet introduction inlet for directing a sheet on which an image was formed by said image forming means;

containing means having a plurality of steps disposed in a line; and a convey member disposed between said sheet introduction inlet and said containing means and movable along the steps of said containing means and adapted to stack a plurality of sheets introduced from said sheet introduction inlet one by one in a sheet bundle, said convey member being shifted, after stacking of the sheets, to a position where said convey member is opposed to a selected step of said containing means to discharge the sheet bundle into said selected step.

22. An image forming apparatus according to claim 21, wherein said convey member has a belt means on which the sheets can be stacked and which can discharge the sheets.

23. An image forming apparatus according to claim 22, wherein said convey member further has a nip rotary member opposed to said belt means.

24. An image forming apparatus comprising;

an image forming means;

a sheet introduction inlet for directing a sheet on which an image was formed by said image forming means;

a containing means having a plurality of steps disposed in a line; and a convey member disposed between said sheet introduction inlet and said containing means and movable along the steps of said containing means and adapted to stack a plurality of sheets introduced from said sheet introduction inlet one by one in a sheet bundle, said convey member being shifted after stacking of said sheets, to a position where said convey member is opposed to a selected step of said containing means to discharge the sheets into the selected step, wherein said convey member includes alignment means for aligning the sheets to be stacked with each other.

25. An image forming apparatus according to claim 24, wherein said convey member has a belt means on which the sheets can be stacked and which can discharge the sheets.

26. An image forming apparatus according to claim 25, wherein said coney member further has a nip rotary member opposed to said belt means.

* * * * *

UNITED STATES PATENT AND TRADEMARK OFFICE

CERTIFICATE OF CORRECTION

PATENT NO. : 5,810,551

DATED : September 22, 1998

INVENTOR(S) : YUJI YAMANAKA

It is certified that error appears in the above-identified patent and that said Letters Patent is hereby corrected as shown below:

On the title page, Item [56],

Insert "OTHER PUBLICATIONS
Patent Abstracts of Japan, vol. 018, no. 613 (M-1709), 11/22/94."

COLUMN 2:

Line 56, "means" (first occurrence) should read --means,--.

COLUMN 7:

Line 22, "(one" should read --(one copy--.

COLUMN 9:

Line 21, "rotary" should read --rotary member--; and
Line 24, "rotary" should read --rotary member--.

UNITED STATES PATENT AND TRADEMARK OFFICE

CERTIFICATE OF CORRECTION

PATENT NO. : 5,810,551

DATED : September 22, 1998

INVENTOR(S) : YUJI YAMANAKA

It is certified that error appears in the above-identified patent and that said Letters Patent is hereby corrected as shown below:

COLUMN 10:

Line 48, "coney" should read --convey--.

Signed and Sealed this

Twenty-fifth Day of May, 1999

*Attest:*

Q. TODD DICKINSON

*Attesting Officer*

*Acting Commissioner of Patents and Trademarks*